United States Patent [19]

Kirk

[11] Patent Number: 4,667,835

[45] Date of Patent: May 26, 1987

[54] HYDRAULICALLY OPERATED CRANES

[76] Inventor: Geoffrey F. Kirk, 30 Freyberg Crescent, Waikanae Beach, New Zealand

[21] Appl. No.: 747,643

[22] Filed: Jun. 21, 1985

Related U.S. Application Data

[63] Continuation-in-part of Ser. No. 444,302, Nov. 24, 1982, Pat. No. 4,553,675.

[30] Foreign Application Priority Data

Nov. 26, 1981 [NZ] New Zealand ..... 199082

[51] Int. Cl.[4] ..... B66C 17/00

[52] U.S. Cl. ..... 212/205; 212/142.1

[58] Field of Search ..... 212/205–221, 212/225, 228, 239, 240, 257, 259, 262, 268, 142.1; 104/98, 107, 108, 110, 118, 244; 254/228, 385, 386, 387

[56] References Cited

U.S. PATENT DOCUMENTS

| | | | |
|---|---|---|---|
| 484,437 | 10/1892 | Kennedy | 212/213 |
| 3,113,681 | 12/1963 | Crile | 212/228 |
| 3,294,252 | 12/1966 | Hosoi et al. | 212/205 |
| 3,844,417 | 10/1974 | Holm | 212/205 |
| 4,132,040 | 1/1979 | Grove | 212/268 |

FOREIGN PATENT DOCUMENTS

| | | | |
|---|---|---|---|
| 1481804 | 3/1969 | Fed. Rep. of Germany | 212/205 |
| 1068184 | 5/1967 | United Kingdom | 212/205 |
| 520316 | 8/1976 | U.S.S.R. | 212/205 |

*Primary Examiner*—Joseph F. Peters, Jr.
*Assistant Examiner*—Stephen P. Avila
*Attorney, Agent, or Firm*—Ladas & Parry

[57] ABSTRACT

A crane has a hollow substantially cylindrical load trolley supporting a girder and a support arrangement for the girder. A trolley track device is positioned on the outside of the hollow cylindrical girder for traversing a load along the girder means. A load trolley is supported upon the trolley track with the trolley track being arranged so that a line of action of a load force is applied tangentially to the hollow cylindrical girder. A hogging arrangement is mounted towards the base of the hollow cylindrical girder. The hogging arrangement includes a tensioning member extending the length of the girder.

13 Claims, 7 Drawing Figures

HYDRAULICALLY OPERATED CRANES

Figure 1:
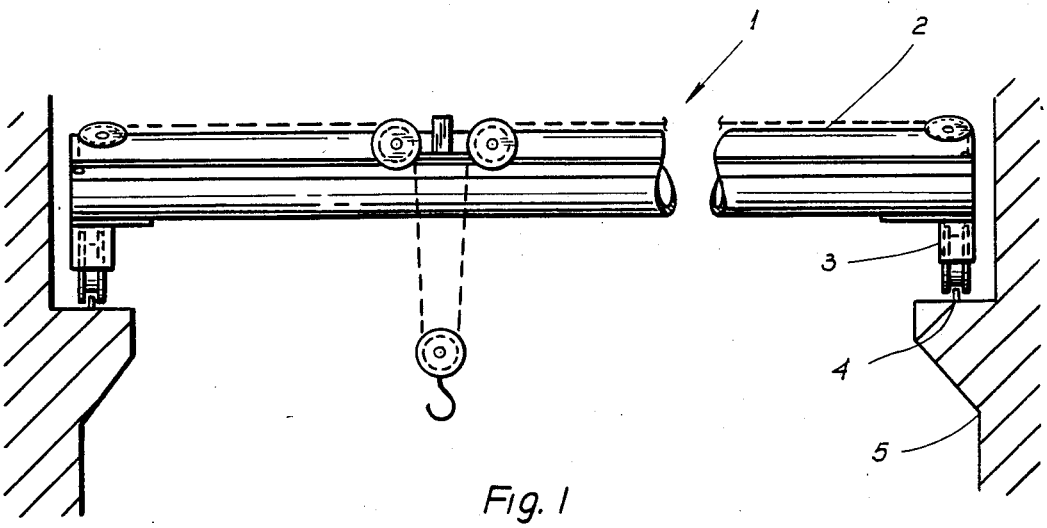

This is a continuation-in-part application of U.S. patent application Ser. No. 444,302 filed 11.24.82 which is now U.S. Pat. No. 4,553,675.

This invention relates to cranes and is concerned particularly with the construction of the jib or bridge girder and associated trolley mounting as employed in the crane.

Conventional cranes employ either box, I beam or lattice type girders. Usually the box and I beam type of girder is employed in bridge cranes and the lattice type girder in the jib or tower crane.

It is an object of the present invention to provide a crane which has a bridge or jib girder more easily constructed to carry the moving load.

It is a further object to provide the bridge or jib girder in a way that will reduce the structural weight while retaining the appropriate strength for the load carrying characteristics required.

It is a further object to provide a bridge or jib girder which can have hogging means incorporated therein without deleterious effect on the structural strength of the girder.

It is a further object to provide a girder which will accommodate components of the crane particularly when the crane is adapted for association with hydraulic operating means.

In order to meet these objects a crane is provided with a bridge or jib girder arranged to support a moving load traversible along said girder wherein said girder comprises a hollow cylindrical structural member, trolley tracks mounted on the hollow cylindrical structural member so that load supported by the trolley track is transmitted to the girder wall as a tangential load, and a trolley supported upon said trolley tracks, said trolley being arranged to carry the load movable by said crane.

Where the girder is provided as a single hollow cylindrical structural member a reaction rail will be needed on the side of the girder remote from the load to counteract the rotational force present with the load supported by the trolley.

The invention also encompasses a twin girder formed from two parallel hollow cylindrical members and in this case the trolley would be supported upon two load bearing rails each transmitting a tangential force to the respective hollow cylindrical member so that the trolley is a bridge between the two members.

The hollow cylindrical member either in its single or double form can have associated therewith structural strengthening means. These structural means can be permanent in the form of strengthening reinforcing members usually for convenience located on the outside and at the top of the girder or it can be in the form of some dynamic strengthening mechanism.

In the case of a dynamic strengthening mechanism a hogging device can be incorporated in the girder which utilises the forces applied to the girder by either the hoisting means or any other force that can induce tension in one or more tie rods located under the neutral axis of the girder and anchored to each end thereof. Where this mechanism is associated with the load being lifted the tension becomes proportional to that load and variable therewith. It is part of the invention to provide a multiplying effect so that the hogging force is substantially increased over and above the lifting force.

DRAWING DESCRIPTION

Figure 2:
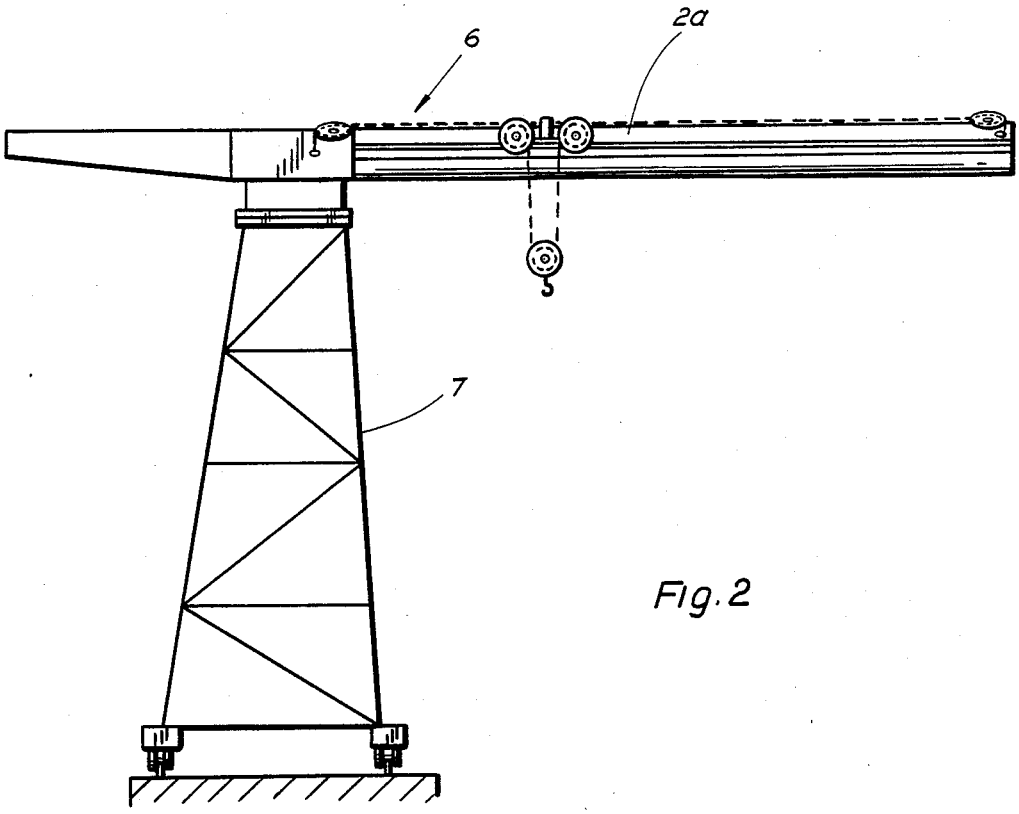
Figure 3:
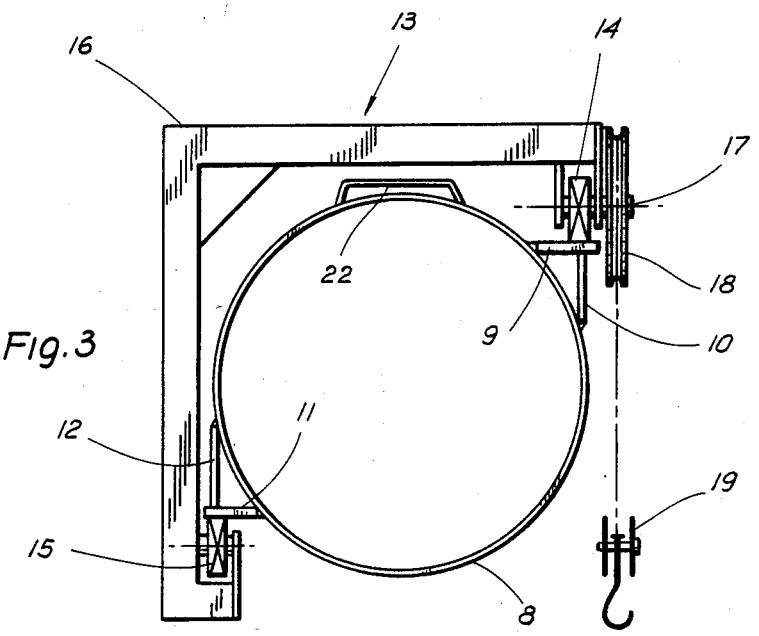

The preferred form of the invention in its various forms will be described with reference to the accompanying drawings in which FIG. 1 is a side elevation of an overhead travelling crane, FIG. 2 is a diagrammatic side elevation of a travelling jib crane incorporating the present invention, FIG. 3 is a detail of a section through a single hollow cylindrical bridge or jib girder showing the trolley tracks and trolley mounted in position.

Figure 4:
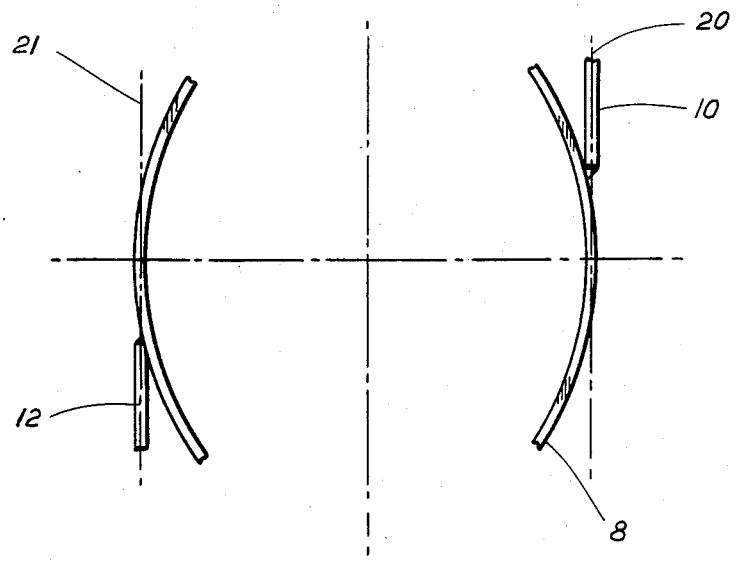
Figure 5:
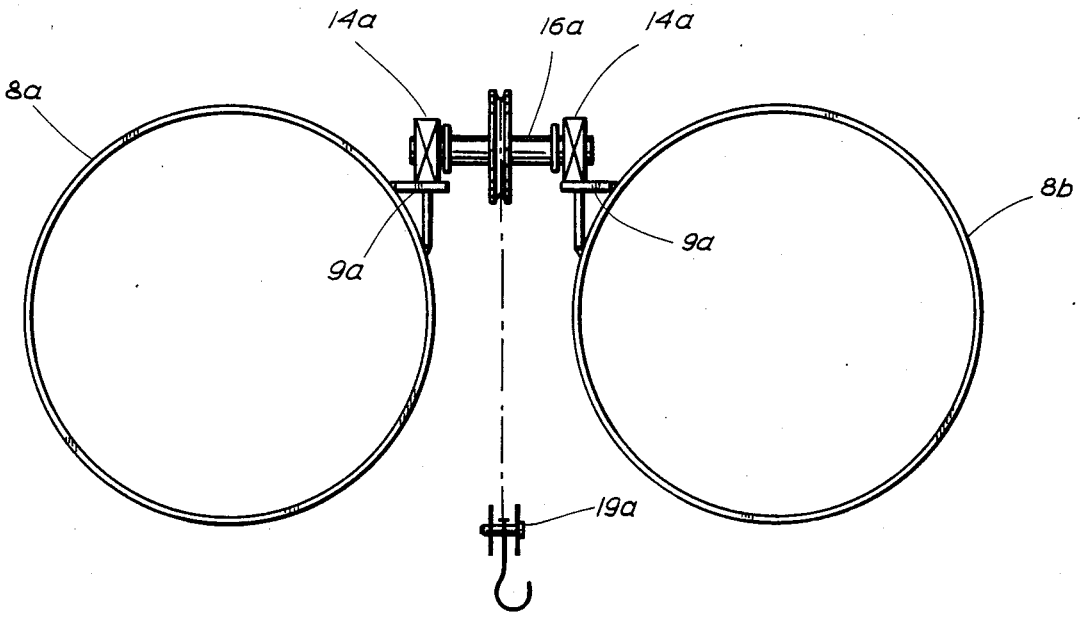
Figure 6:
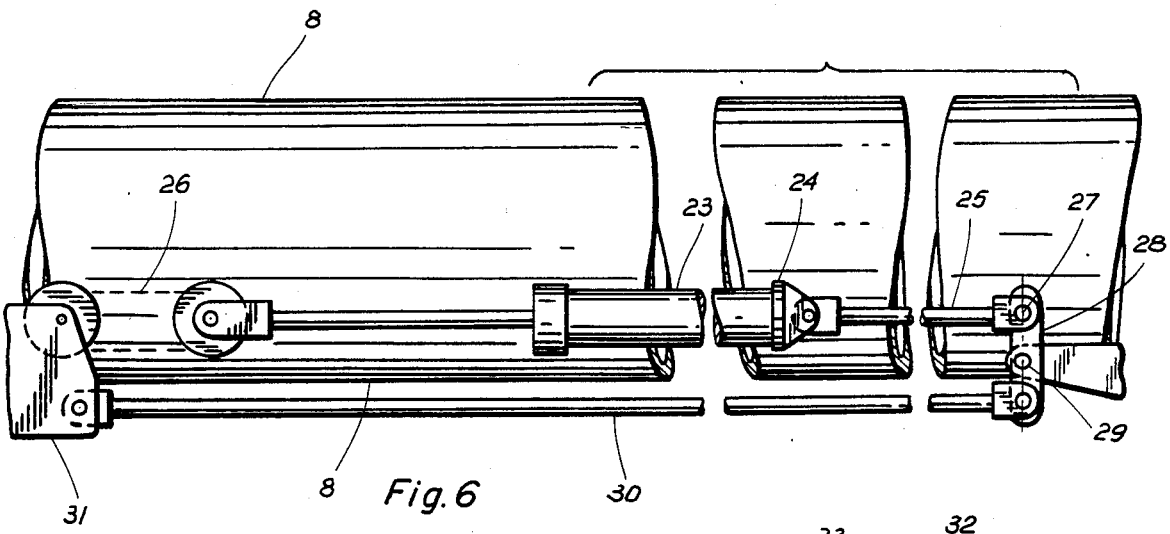
Figure 7:
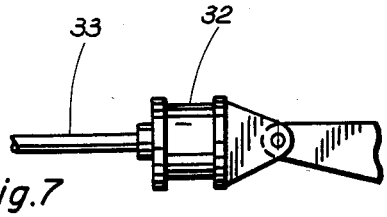

FIG. 4 is a further detail showing the preferred loading pattern on the hollow cylindrical member FIG. 5 is a diagrammatic representation of twin hollow cylindrical girders having the trolley supported therebetween, and FIG. 6 is a detail of a girder hogging means, and FIG. 7 is detail of a modified girder hogging means.

PREFERRED EMBODIMENT

The present preferred embodiment of the invention is designed for use with a bridge or a jib type crane. A typical arrangement of a bridge crane 1 is illustrated in FIG. 1. The bridge provided by the hollow cylindicral member 2 is supported on end carriages 3 running on rails 4 supported on a corbel 5 in a building. In the bridge type crane we intend to include the goliath crane where the tracks 4 would be mounted on the ground and the carriages comprise towers extending from the grounds tracks to support the bridge at the appropriate height.

The invention also applies to a jib type crane 6 illustrated in FIG. 2. In this instance the hollow cylindrical structural member **2*a* is mounted on a tower structure 7. The invention is also intended to encompass a tower or jib crane where the jib formed from the structural member 2*a*** is supported by ropes or by ties from an upper part of the structure extending above the jib.

The present invention is primarily concerned with the hollow cylindrical structural member 8 for example as shown in FIG. 3 and the manner in which the load is carried thereon. The cylindrical structural or girder 8 may be fabricated relying upon standard pipe sections having a diameter consistent with the load to be lifted and the span to be bridged. For example a standard pipe section having a diameter of one meter can be used to form the hollow structural member in the jib or bridge of a crane having a 10 ton capacity with the traversing distance between supports of 20 meters. However the hollow cylindrical structural member 8 may also be fabricated from suitable metal plate formed by rolling or other manufacturing technique.

The important characteristic of the present invention is to ensure that the load carried by the crane on the structural member 8 is supported so that the vertical force due to the load passes through the wall of the hollow cylindrical member 8.

In order to achieve this a load carrying rail 9 is supported on the outer surface of the cylindrical structural member 8 the rail can be fabricated in a number of manners but the form illustrated requires the rail to be provided by a plate 9 supported on a vertical member 10 with the two plates welded to the hollow cylindrical structural member 8 so that the load that is to be transmitted will pass through the centre line of the member 10.

This load bearing rail is of consistent configuration whether applied to the single hollow cylindrical structure as illustrated in FIG. 3 or is used on the twin structure as illustrated in FIG. 5.

In the case of the single hollow cylindrical member a reaction rail 11 is located at a position remote from the load rail 9 and the configuration of this rail is similar to that previously described with a support member 12 provided to structurally support the rail 11 relative to the periphery of the hollow cylindrical member 8. In the preferred example the reaction rail 11 is diammetrically opposed to the load rail but while this configuration is preferred it is not essential and the reaction rail could be located at any position provided the rotational forces that were generated in the supported trolley could in use adequately be compensated through the association with the reaction rail.

A trolley 13 is supported on the rails 9 and 11 with wheels 14 and 15 carried in an appropriate frame 16 which is supported about the hollow cylindrical member 8. Usually there is a set of two wheels spaced apart on rail 9 and the shaft 17 form each wheel projects to support a rope sheave 18 from which is suspended the hook block 19. The moment generated by the offset of the loading on the hook block creates the rotational force which must be absorbed on the reaction rail 11 through connection with the reaction wheels 15 of the trolley 13.

The preferred arrangement for the loading of the hollow cylindrical member 8 is identified in FIG. 4. The loading signified by the dotted lines 20 should be designed to pass through the centre line of the hollow cylindrical girder 8 at the horizontal diameter through the member 8 as this is at the point where there is the minimum effect of the primary bending forces. While the invention can be applied with a deviation from the this location of loading it is the preferred or optimum position to which a designer would ordinarily wish to aspire. The reaction load 21 is in the preferred form similarly located. In this case the positioning of the reaction load is considerably less critical because the loading is much lower in magnitude and consequentially the designers choice as to the form of reaction rail and the location of the reaction rail is such as will enable the positioning to be on a wide portion of the circumference of the member 8. Also it would not be so necessary for this load to pass through the centre line of the member forming the shell 8.

The single hollow cylindrical structural member 8 would normally be employed but there are circumstances for example because of height restraint or otherwise where it may be necessary to achieve some saving in the diameter of the hollow structural member this can be achieved with a construction using parallel hollow cylindrical members **8*a* and 8*b*. In this case a load carrying rail similar to that previously described is provided on each of the members 8*a* and 8*b* so that a two sets of wheels 14*a* supporting a carriage 16*a* running on the rails 9*a*. In this way the tangential load is shared between the hollow cylindrical members 8*a* and 8*b* and the hook block 19*a* is carried by the carriage 16*a***. Because of the balanced load so created there is no reaction force and hence no need for the reaction rail but merely the two load carrying rails.

The present invention utilises the hollow structural member in such a manner that the loading means on and the location of the trolley do not occupy the portion of the hollow cylindrical member where reinforcing members will have the maximum advantage; this being at the centre top or centre bottom of the member and reinforcing members can be therefore located in either position. Ordinarily a reinforcing member 22 will be welded to the outside of the cylinder at the centre top thereof thereby increasing the strength of the hollow cylindrical member by locating the member 22 at the top of the hollow cylindrical member 8 and thus raising the neutral axis of the member. This has particular advantage where hogging means art incorporated in the beam. The hogging means will be described in further detail herebelow. From a theoretical point of view the reinforcing could equally be formed inside the hollow cylindrical member but from a practical point of view this is more difficult.

Another advantage of the hollow cylindrical member and the manner in which the load is supported therefrom is that the creation of hogging forces in the member generates a minimum of undesirable structural effects as the nature of the strength of the hollow cylindrical structural member is such as to react favourably to this type of impressive loading. The present invention is designed to achieve hogging which is directly proportional to the load being lifted. In this way the performance and deflection of the bi-structural member is significantly improved.

A hogging means in one form is illustrated in FIG. 6 where the hogging means is located towards the base of the hollow cylindrical member 8 with part of the mechanism inside the member and part externally fitted. A ram 23 designed to lift a load supported through the trolley 16 has the end 24 fixed to a tie rod 25 that extends the length of the structural member 8 and is anchored at the opposite end of the member 8. A conventional double acting ram with a multiplying hoist 26 can be employed in this regard. However a much greater hogging force can be created by connecting the anchor point 27 to the top of a lever 28 pivoted on the end of the girder 8 at a pivot point 29. The bottom of the lever 28 would also be pivotally connected to a tie rod 30 running back beneath the hollow structural beam 8 and connected to an anchor 31 at the opposite end of the member 8. By selecting a mechanical advantage through the lever 28 it is possible to obtain a multiplying effect of for example 2 to 1 on the pull in the tie rod 30 and thereby achieve a significantly higher pull hogging many tonnes in excess of the load being lifted. The mechanical advantage generated through the lever 28 can be anything within practical limitations.

As the hogging moment is not only dependant on the hogging force but also on the distance the hogging forces are located below the neutral axis of the crane girder, and as the use of structural reinforcing means increases this distance, the designer can combine the structural and dynamic strengthening means to minimise the mass of the crane girder.

A hogging device dependant upon an arrangement which will give with an effect proportional to the load can be achieved in other ways. For example FIG. 7 shows a supplementary cylinder 32 energised at the same time that the main cylinder is energised to react upon a tie rod 33 that can either again be merely a direct tie rod or can operate through the lever and return tie rod arrangement as illustrated in particular in FIG. 6.

An example of the impact of the hogging device according to the present invention is illustrated in the following table which shows the effect of the device on the mass of the girder of a 5 tonne 20 meter span overhead travelling crane:

| Method of Construction | Mass of Girder |
|---|---|
| Mild steel with no hogging device | 4000 kg |
| Mild steel with hogging device | 3319 kg |
| Alloy steel with hogging device | 2818 kg |
| Aluminium alloy with hogging device | 1500 kg |

The hogging means therefore not only reduces the mass of a girder constructed of mild steel but also permits the use of attractive lightweight high strength materials which are not used to any extent in crane bridges because of excessive deflection under load.

The present invention thereby provides a structure for use in a crane either of a bridge type or a jib type which has significant structural advantages not only in the way in which the load is supported, and the manner in which the hollow cylindrical structural member can be reinforced, but also in allowing the use of a wider range of materials from which the girder can be constructed.

This structure can be employed with more conventional techniques of providing power for the hoisting and traversing such as electrical drives and motors but has been particularly designed for use in association with the hydraulic drive the practically unobstructed hollow interior of the structural member providing an appropriate location and housing within which the componentry or a major portion of the componentry of the crane can be located.

What is claimed is:

1. A crane comprising hollow substantially cylindrical load trolley supporting girder means, support means for said hollow cylindrical girder means, trolley track means on the outside of the hollow cylindrical girder means for traversing a load along said hollow cylindrical girder means, and a load trolley supported upon said trolley track means with the trolley track means arranged so that the line of action of the load forces is applied tangentially to said hollow cylindrical girder means.

2. A crane as claimed in claim 1 wherein the hollow substantially cylindrical girder means comprises a single hollow cylindrical girder with the trolley track means comprising in turn an action rail attached to the outside of the single hollow cylindrical girder with the line of action of the load forces supported by the action rail applied tangentially substantially through the centre line of the wall of the single hollow cylindrical girder and with a reaction rail attached to the opposite outside of the hollow cylindrical girder.

3. A crane as claimed in claim 2 wherein the action rail is supported by a support plate located so that the line of action of the load passes substantially centrally through the support plate and a wall of the single hollow cylindrical girder substantially at the horizontal axis of the girder.

4. A crane as claimed in claim 3 wherein the reaction rail is supported in a manner similar to the action rail with the reaction force passing substantially through the centre of the wall of the hollow cylindrical girder.

5. A crane comprising twin parallel hollow cylindrical girders, support means for said twin parallel hollow cylindrical girders, action trolley tracks on the outside of adjacent surfaces of each of the said twin parallel hollow cylindrical girders for traversing a load along said twin parallel hollow cylindrical girders, and a load trolley supported upon the action trolley tracks between the twin parallel hollow cylindrical girders so that the load is divided and the line of action of each component is applied tangentially to the associated hollow cylindrical girder.

6. A crane as claimed in claim 5 wherein each action rail is supported by a support plate located so that the line of action of the load passes substantially centrally through the support plate and a wall of the associated hollow cylindrical girder substantially at the horizontal axis of the girder.

7. A crane comprising hollow cylindrical load trolley supporting girder means, support means for said hollow cylindrical girder means, trolley track means on the outside of the hollow cylindrical girder means for traversing a load along the hollow cylindrical girder, a load trolley supported upon said trolley track means with the trolley track means arranged so that the line of action of the load forces is applied tangentially to said hollow cylindrical girder means, and reinforcing means associated with said hollow cylindrical girder means.

8. A crane as claimed in claim 7 wherein said reinforcing means comprises a reinforcing member welded to the top of each hollow cylindrical girder making up the hollow cylindrical girder means at the centre top to strengthen and raise the axis of said hollow cylindrical girder.

9. A crane comprising hollow substantially cylindrical load trolley supporting girder means, support means for said hollow cylindrical girder means, trolley track means on the outisde of the hollow substantially cylindrical girder means for traversing a load along the hollow cylindrical girder means, a load trolley supported upon said trolley track means with the trolley track means arranged so that a line of action of a load force is applied substantially tangentially to said hollow cylindrical girder means, and hogging means mounted towards the base of said hollow cylindrical girder, said hogging means comprising a tensioning member extending the length of said hollow cylindrical girder means and anchored substantially to the ends thereof and tensioning means acting to induce a tension in said tension member.

10. A crane as claimed in claim 9 wherein a hydraulic hoist ram associated rope and sheave system of said tensioning member and tensioning means are mounted in the interior of the crane towards the base thereof with the anchor point of the hoisting cylinder attached to a lever pivotally supported on an anchor point and providing on the opposite side of the pivotal anchor point a mounting for said tensioning member with the tensioning member extending the length of the girder on the under side thereof so that the reaction force generated by the lifting cylinder is transmitted through the lever to tension the tensioning member.

11. A crane as claimed in claim 9 wherein a hydraulic cylinder is incorporated in a tensioning rod running towards the bottom of said hollow cylinder with said hydraulic cylinder generating the required tensioning force in the tensioning rod.

12. A crane according to claim 9 further comprising said hollow substantially cylindrical girder means having a substantially cylindrical girder, a crossection of said cylindrical girder having a first upright axis and a second axis substantially perpendicularly to the upright axis, said first and second axes crossing each other at a center line of the cylindrical girder; the trolley being supported by at least one load carrying rail arrangement, said rail arrangement being positioned on the substantially cylindrical girder above the second axis so that a reaction load is tangential to a wall of the cylindrical girder.

13. A crane arrangement according to claim 9 wherein the load carrying rail arrangement has at least one upright member and a support member for supporting the position of the upright member on the substantially cylindrical girder so that the reaction load passes through a longitudinal axis of the upright member tangentially to the wall of the cylindrical girder at a point where primary bending forces have the minimum effect.

* * * * *